US005287876A

United States Patent [19]

Takahashi

[11] Patent Number: 5,287,876

[45] Date of Patent: Feb. 22, 1994

[54] WATER PIPING SYSTEM

[75] Inventor: Yoshishige Takahashi, Tokyo, Japan

[73] Assignee: Kabushiki Kaisha Oze, Japan

[21] Appl. No.: 812,040

[22] Filed: Dec. 23, 1991

[30] Foreign Application Priority Data

Jul. 22, 1991 [JP] Japan ..... 3-271741
Aug. 29, 1991 [JP] Japan ..... 3-242346

[51] Int. Cl.[5] ..... E03B 7/12; F16L 55/00

[52] U.S. Cl. ..... 137/62; 137/80; 137/341; 137/357; 137/418; 137/486; 137/487.5; 237/80

[58] Field of Search ..... 137/59, 61, 62, 80, 137/341, 79, 468, 487.5, 357, 486; 237/80

[56] References Cited

U.S. PATENT DOCUMENTS

| | | | |
|---|---|---|---|
| 548,733 | 10/1895 | Williams | 137/61 |
| 1,003,307 | 9/1911 | Walker | 137/61 |
| 4,280,478 | 7/1981 | Duval et al. | 137/61 |
| 4,730,637 | 3/1988 | White | 137/62 |
| 4,848,389 | 7/1989 | Pirkle | 137/62 |
| 5,113,892 | 5/1992 | Hull et al. | 137/62 |

FOREIGN PATENT DOCUMENTS

| | | | |
|---|---|---|---|
| 2200941 | 9/1987 | United Kingdom | 137/59 |

*Primary Examiner*—George L. Walton

[57] ABSTRACT

The present invention provides a water piping system wherein when a predetermined time elapses after the flow of the water in a hose has stopped, the water is drawn out of the hose, thereby preventing proliferation of various bacteria in the water standing stagnant in the hose and when the temperature of the water drops, the water is completely drawn out of the hose, thereby preventing a water pipe from rupturing or cracking in the wintertime. The water pipe including a reducing valve which is at a position higher than a waterstop valve is connected with a hose through a first electromagnetic valve. The required number of second electromagnetic valves are located intermediate on the hose. When a predetermined time elapses after the flow of the water through the hose has stopped, the first valve is temporalily closed while the second valves are opened. When a water-temperature sensor incorporated into one of the second valve senses that the temperature of the water has dropped to a predetermined lever, the first valve is closed while the second valves are put open.

2 Claims, 1 Drawing Sheet

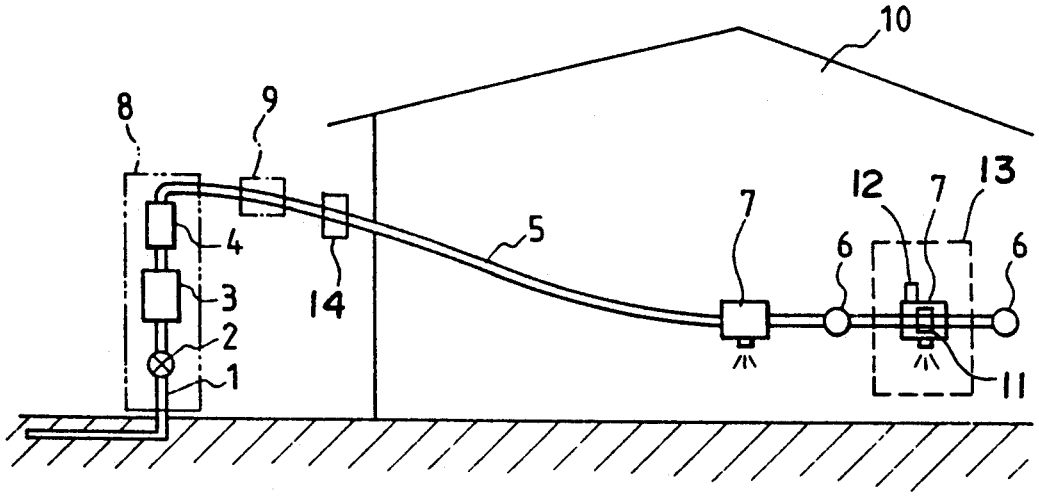
10
8
9
12
7
13
7
5
6
6
4
3
14
2
1
11

WATER PIPING SYSTEM

BACKGROUND OF THE INVENTION

1. Field of the Invention

The present invention relates to a water piping system.

2. Prior Art

City water is more or less sterilized in water disposal installations, but various bacteria tend to proliferate when water stands stagnant. This takes place whether in the summer period or in the wintertime. But especially at constantly high temperatures, like in the summer period, various bacteria proliferate vigorously or, sometimes proliferate even in a very short span of time. Such proliferation is often found in the vicinity of the ends of water hoses, and this is one of the leading causes of bacteria-induced gastroenteric disorder suffered by many people especially during the summer period. This is particularly true for places closer to or on the equator, where daytime temperatures are extremely high.

At low temperatures, especially in cold districts, water pipes often rupture or crack during the winter period. This is because the water standing stagnant in the water pipes is chilled and frozen.

In order to cope with this, it has been proposed and practiced to cover water pipes with heat-insulating materials such as foamed styrol, thereby making the freezing of the water therein less likely to occur.

However, this proposal incurs too much labor and expense and, besides, water often freezes even if the pipes are covered.

In view of the above problems, this invention seeks to provide a water piping system designed such that after a certain period of time has elapsed after the flow of water through a hose has stopped, the water is drawn out of the hose, thereby preventing proliferation of various bacteria in the water standing stagnant in the hose. Also when the temperature of the water drops to a predetermined level, the water is completely removed from the hose, thereby preventing the water pipe from rupturing or cracking in winter.

SUMMARY OF THE INVENTION

According to one aspect of this invention, the above object is achieved by the provision of a water piping system comprising a water pipe 1 including a reducing valve 3 which is at a position higher than a waterstop valve 2, a hose 5 connected with said water pipe 1 through a first electromagnetic valve 4 and second electromagnetic valves 7 located intermediate on the hose, whereby when a predetermined time elapses after the flow of water through said hose 5 has stopped, said first valve on said water pipe 1 is temporarily closed, while said second valves 7 located intermediate on said hose 5 are held open.

According to another aspect of this invention, there is provided a water piping system comprising a water pipe 1 including a reducing valve 3 which is at a position higher than a waterstop valve 2, a hose 5 connected with said water pipe 1 through a first electromagnetic valve 4, second electromagnetic valves 7 located intermediate on said hose 5 and a water-temperature sensor built in one of said electromagnetic valves 7 for sensing the temperature of the water in said hose 5, whereby when said temperature sensor detects that the temperature of the water in said hose 5 has dropped to a predetermined temperature, said second valves 7 are actuated to draw the water out of said hose 5 while said first valve 4 is actuated to stop water supply, and when said water-temperature sensor detects that the temperature of the water in said hose 5 has risen to a predetermined temperature, said first and second valves 4 and 7 are automatically actuated in the manner reverse to that described above.

According to the third aspect of this invention, there is provided a water piping system comprising a water pipe 1 including a reducing valve 3 which is at a position higher than a waterstop valve 2, a hose 5 connected with said water pipe 1 through a first electromagnetic valve 4, second electromagnetic valves 7 located intermediate on said hose 5 and a water-temperature sensor built in one of said second valves 7 for sensing the temperature of the water in said hose 5, whereby when said temperature-sensor detects that the temperature of the water in said hose 5 has dropped to a predetermined temperature, said second valves 7 are actuated to draw the water out of said hose 5 while said first valve 4 is actuated to stop water supply, and when said water-temperature sensor detects that the temperature of the water in said hose 5 has risen to a predetermined temperature, said first and second valves 4 and 7 are automatically actuated in the manner reverse to that described above, said water piping system further including a temperature sensor on the outside of one of said second valves 7 for sensing the ambient temperature, whereby when said temperature sensor detects that the ambient temperature has dropped to a predetermined temperature, a heater means, in which said electromagnetic valves 7 are enveloped, is actuated, and when the ambient temperature rises, said heater means stop heating.

According to the fourth aspect of this invention, there is provided a water piping system comprising a water pipe 1 including a reducing valve 3 which is at a position higher than a waterstop valve 2, a hose 5 connected with said water pipe 1 through a first electromagnetic valve 4, second electromagnetic valves 7 located intermediate on said hose 5, whereby when a predetermined time elapses after the flow of the water through said hose 5 has stopped, said first valve 4 on said water pipe 1 is temporarily closed, while said second valves 7 located intermediate on said hose 5 are held open, and further including a water-temperature sensor built in one of said second valves 7 intermediate of said hose 5, whereby when said temperature sensor detects that the temperature of the water in said hose 5 has dropped to a predetermined temperature, said first valve 4 on said water pipe 1 is closed while said second valves 7 are held open.

BRIEF DESCRIPTION OF THE DRAWING

This invention will now be explained specifically but not exclusively with reference to the FIGURE which is an illustrative sketch showing one embodiment of this invention.

DETAILED DESCRIPTION OF THE INVENTION

When a predetermined time elapses after a sensor such as a flowmeter device, located intermediate on a hose or water pipe, detects that the flow of water through the hose has stopped, electromagnetic valve on the water pipe (hereinafter referred to as first valve) and the electromagnetic valves located intermediate on the hose (the second valves) are simultaneously actuated; that is, the first valve is closed to stop the water supply and the second valves are held open to draw the water out of the hose.

It is thus possible to prevent the proliferation of various bacteria in the water standing stagnant in the hose.

Once the water has been let out of the hose, the first and second valves return automatically to their original position. It is noted that this may be manually achieved by operating a separately provided re-start button.

The decision as to when the water is to be drawn out of the hose (after the flow of the water through the hose has stopped) or how long the water should be let out of the hose may be determined in consideration of various factors, one of which is ambient.

As a water-temperature sensor built in one of the second valves located on the horizontally extending portion of the hose detects that the water in the hose has dropped to a predetermined level (about 5° C.), the second and first valves are simultaneously actuated; that is, the former valves are held open to draw the water out of the hose and the latter valve is held closed to stop the water supply.

In this way, when the temperature of the water in the hose has dropped to a predetermined level (about 5° C.), it is possible to let the water out of the hose completely. Hence, the hose would be very unlikely to rupture or crack due to freezing of the water in the hose.

By contrast, as the water-temperature sensor detects that the temperature of the water in the hose has risen to a predetermined level (about 5° C.), the second and first valves are actuated in the manner reverse to the foregoing.

In other words, the second valves are turned off to close the water-discharge outlet and the first valve is turned on to resume water supply.

Furthermore, as a temperature sensor provided on the outside of one of the second valves detects that the ambient temperature has dropped to a predetermined level (about 5° C.), heaters having the second valves housed in them are turned on for a predetermined time to heat the second valves, whereby the second valves can be prevented from breaking down or being made inoperable by reason of the freezing, etc. of droplets of water found in the range within which the second valves are at work. As the ambient temperature has risen to a predetermined level (10° C. or higher), on the other hand, the heaters adapted to heat the second valves are automatically turned off.

More preferably, the heaters for heating the second valves should be automatically de-energized upon the ambient temperature reaching a high level of 40° C. or higher.

As the ambient temperature drops to about 5° C. or below, the first valve is heated by a heater in which it is housed, thereby preventing its freezing. It is desired that in the course of heating, the first valve be always maintained at approximately 10° C.

Bear in mind that the water in the hose decreases in temperature as it goes farther from the water pipe. This is because the water is constantly flowing through a portion of the hose close to the water pipe, but as it goes farther from there, it is likely to stand stagnant and lie at the lower-limit temperature of 5° C. or below. In addition, since the second valves, any one of which has the water-temperature sensors, are located on the hose farther away from the water pipe, the second and first valves are likely to be often turned on and off, as already mentioned.

Whenever this takes place, the respective valves must be manually operated, but such manual operations are very troublesome. For this reason, the furthermost electromagnetic valve is sometimes actuated for approximately two seconds to discharge an amount of the water, thereby adjusting the temperature of the water in the furthermost portion of the hose and not allowing the water to drop to some 5° C. or lower. Unless the temperature of the water increases to 5° C. or higher even by doing this, all the second valves are then actuated to force the water out of the hose.

As the ambient temperature drops to about 5° C. or below, as mentioned above, the heaters for heating the second valves located intermediate on the hose are put in operation for a predetermined time to heat them. However, it is noted that in the course of being heated, the temperature of the water in the hose is increased correspondingly. This in turn causes the temperature of the water in the hose to be higher or lower than about 5° C. Thus, the first valves are turned on and off several times a day, and whenever turned on, they allow the water to enter into the hose.

To avoid this, the first and second valves should be all designed such that once they have been actuated, i.e., the first and second valves have been turned off and on, respectively, such off and on conditions are maintained until the re-start button is pushed to put the first valve on and the second valves off.

The electromagnetic valves are being energized while at work, but the continuous operation of them at night incurs some expense; hence, it is desired that they be designed such that once they have been actuated, i.e., the first valve is turned off and the second valves are turned on, the second valves are de-energized. Keep in mind that the first valve remains energized, thereby making it possible to save the power needed for operating the second valves.

Water leakage, which rarely happens according to this invention, may possibly ensue due to hose rupture or failures of some parts, and this would account for water waste. To avoid this, it is desired that the first valve be turned off by a timer, flowmeter or other device according to a preset flow time and rate, i.e., when a pre-determined time elapses or when a predetermined amount of water flow is reached. In order to resume water supply, the re-start button may be pushed to put the first valve on.

DESCRIPTION OF THE PREFERRED EMBODIMENT

In what follows, one specific embodiment of this invention will be explained with reference to FIG. 1.

Reference numeral 1 stands for a water pipe which includes a waterstop valve 2. Between the waterstop valve 2 and a hose 5, to be described later, there is provided a reducing valve 3 for the purpose of reducing the pressure of the water to a predetermined level, thereby preventing deterioration of the hose by pressure.

Between the reducing valve 3 and the hose 5 there is located a first electromagnetic valve 4 which in automatically closed, when a sensor device, such as, a flowmeter 9 for example, detects that the flow of the water through the hose has stopped or when a water-temperature sensor 11 to be described later, detects that the temperature of the water in the hose has dropped to a predetermined level.

The hose 5 is made of such soft material as rubber or vinyl, and is connected through a junction 6 with a cock located intermediate thereon.

A plurality of second electromagnetic valves 7 are located intermediate on the hose 5 and are positioned on the horizontally extending portion of the hose so as to easily and completely discharge the water out of the hose.

It is noted that while the number of the second electromagnetic valves 7 is two in the illustrated embodiment it may be one or more than three.

At least one of the second valves 7, actuated simultaneously with the first valve 4, includes therein a water-temperature sensor 11. According to this embodiment, the second valves 7 are turned on to discharge the water out of the hose when either the flow of the water through the hose has stopped or the temperature of the water in the hose has dropped to a predetermined level (about 5° C.), below which the water will be frozen. Simultaneously, the first valve 4 is turned off to stop the water supply.

Once the water has been drawn completely out of the hose or once the temperature of the water has risen (to about 5° C. or higher), the first and second valves are automatically actuated in the manner reverse to that described above.

In some cases, a supply of water may be needed even when its temperature has dropped. To cope with this, the first and second valves 4 and 7 are adapted to be actuated manually regardless of the water-temperature sensor.

Furthermore, as a temperature sensor 12 provided on the outside of at least one of the second valves 7 detects that the ambient temperature has dropped to a predetermined level (about 5° C.), heaters 13 having the second valves housed in them are held on for a predetermined time to heat the second valves, whereby their breaking down or being made inoperable by reason of the freezing, etc. of droplets of water discharged by the second valves 7 can be prevented.

As there is a rise in the ambient temperature, the heaters are also turned off automatically.

Furthermore, the heaters are turned off at an abnormally high temperature of 40° C. or higher.

The furthermost electromagnetic valve is adapted to be occasionally opened for approximately two seconds to discharge an amount of water. Unless the temperature of the water can be increased to 5° C. or higher by doing this, all the second valves are then actuated to remove the water from the hose.

The second valves 7 are also designed such that once actuated and held on, they are put off, thereby achieving power saving. Bear in mind that the first valve 4 remains at work.

As the ambient temperature drops to about 5° C. or lower, a heater 8 on the first valve 4 is actuated to heat it.

Water leakage, which rarely happens according to this invention, may possibly be caused by hose rupture or failures of some parts, and this would account for water waste. To avoid this, it is desired that the first valve be turned off by a timer, flowmeter or other device according to a preset flow time and rate, i.e., when a pre-determined time elapses or a pre-determined amount of water flow is reached.

A flowmeter 9 is located intermediate on the hose. In order to resume water supply, a re-start button (not shown) is pushed to turn the first valve 4 on.

The flowmeter 9 plays an additional role in sensing the flow of the water. When the flowmeter 9 senses that the flow of the water through the hose has stopped, a timer or other device, 14, is actuated whereby, after a lapse of some predetermined time, the second valves 7 are temporarily turned on simultaneously while turning the first valve 4 off.

When the first and second valves 4 and 7 are automatically opened or closed as mentioned above, for instance, when the first and second valves 4 and 7, once actuated, are held off and on, respectively, there is caused inconvenience. In other words, when the heaters for the second valves 7 are actuated for a predetermine span of time with the second valves 7 being held on, there is a rise in the temperature of the water in the hose while they are being heated, which in turn causes that water to be higher or lower than about 5° C. Thus, the first valve 4 is likely to be turned on and off several times a day.

To avoid this, the first and second valves 4 and 7 should be all designed such that once they have been actuated, i.e., the first and second valves 4 and 7 have been turned off and on, respectively, such off and on conditions are maintained until a re-start button (not shown) is pushed to turn the first and second valves 4 and 7 on and off, respectively.

In the FIGURE, reference numeral 10 stands for a house.

According to the construction and action of this invention as mentioned above, wherein when a predetermined time elapses after the flow of the water through the hose has stopped, the water is drawn out of the hose, it is possible to prevent proliferation of various bacteria in the water standing stagnant in the hose.

At low temperatures of water, as in the wintertime, it is also possible to draw the water out of the hose automatically. Accordingly, such problems as hose rupture or cracking ensuing from the freezing of the water in the hose do not occur at all. Advantages with using rubber or vinyl hose rather than leaden pipes so far used for water pipes are that they are not only inexpensive but easy to lay down as well.

In addition, upon the ambient temperature having dropped to a predetermined level, the second electromagnetic valves are so automatically heated that droplets of the water discharged by them or the water in touch with them are unlikely to be frozen, preventing them from being inoperable or breaking down.

Further, once the first and second electromagnetic valves have been actuated, the second electromagnetic valves may be de-energized, thereby achieving power saving.

Still further, once the first and second valves have been actuated in response to a drop in the temperature of a water, they remain at work until the re-start button is pushed. Thus, it is unlikely that the first electromagnetic valve may be turned on and off several times a day.

Still further, with the electromagnetic valve positioned on the furthermost location of the hose, it is possible to regulate the system by sometimes opening it for a short span of time so as to increase the temperature of the water in the farthermost portion of the hose. If this is insufficient, then all the second electromagnetic valves might be opened. Thus, it is possible to prevent the first and second valves from being frequently put on and off.

What is claimed is:

1. Apparatus for preventing stagnation in a fluid distribution system comprising:

fluid flow distribution means having a fluid inlet means and a fluid outlet means;

means for detecting fluid flow rate within the fluid distribution means;

timing means for measuring a predetermined period of time at which said means for detecting fluid flow senses zero flow rate in the distribution system;

means for detecting fluid temperature within the fluid distribution means, said detecting means generating a first signal when a predetermined fluid temperature is detected;

ambient temperature sensing means for generating a second signal when a predetermined ambient temperature is detected;

first valve means for controlling fluid flow at said inlet means, said first valve means being closed in response to said first signal;

second valve means for controlling discharge of said fluid from said fluid distribution means at a point intermediate said inlet means and said outlet means, said second valve means being opened in response to said first signal to discharge said fluid from said fluid distribution system;

heating means for heating said second valve means, said heating means actuated in response to said second signal to heat said second valve means; and means for discharging the fluid from said distribution means in response to a signal from said means for detecting said period of zero fluid flow rate.

2. The apparatus of claim 1, wherein said first valve means and said second valve means are electromagnetic valves.

* * * * *

UNITED STATES PATENT AND TRADEMARK OFFICE

CERTIFICATE OF CORRECTION

PATENT NO. : 5,287,876

DATED : February 22, 1994

INVENTOR(S) : YOSHISHIGE TAKAHASHI

It is certified that error appears in the above-identified patent and that said Letters Patent is hereby corrected as shown below:

On the cover page, in the Abstract, line 16 of the Abstract, "temporalily" should read --temporarily--.

Signed and Sealed this

Second Day of August, 1994

*Attest:*

*Attesting Officer*

BRUCE LEHMAN

*Commissioner of Patents and Trademarks*